US006856302B2

(12) United States Patent
Gonçalves et al.

(10) Patent No.: US 6,856,302 B2
(45) Date of Patent: Feb. 15, 2005

(54) UNIVERSAL ANTENNA MOUNT

(75) Inventors: João Paulo Sanmarful Gonçalves, Rua Teófilo Carvalho dos Santos n.° 4, 3° Esq. 2685-382, Prior Velho (PT); Jorge Luis Silva Mendes Maria, Costa de Caparica (PT); Miguel António Picareta Jorge, Caxias (PT); António Marino Naeff Ferreira, Parede (PT)

(73) Assignee: João Paulo Sanmarful Gonçalves, Prior Velho (PT)

( * ) Notice: Subject to any disclaimer, the term of this patent is extended or adjusted under 35 U.S.C. 154(b) by 0 days.

(21) Appl. No.: 10/349,861

(22) Filed: Jan. 23, 2003

(65) Prior Publication Data

US 2003/0189527 A1 Oct. 9, 2003

(30) Foreign Application Priority Data

Apr. 4, 2002 (PT) ..... 102751

(51) Int. Cl.[7] ..... H01Q 1/12; A47B 96/06
(52) U.S. Cl. ..... 343/890; 248/219.4
(58) Field of Search ..... 343/890, 891, 343/892; 52/40; 248/219.4

(56) References Cited

U.S. PATENT DOCUMENTS

| | | | | | |
|---|---|---|---|---|---|
| 4,799,642 | A | * | 1/1989 | Wright | 248/516 |
| 5,787,673 | A | * | 8/1998 | Noble | 52/726.1 |
| 6,018,325 | A | | 1/2000 | Lundgren | |
| 6,043,795 | A | | 3/2000 | Strieffler et al. | |
| 6,343,440 | B1 | * | 2/2002 | Ayers | 52/40 |
| 6,513,299 | B1 | * | 2/2003 | Damiano | 52/651.02 |
| 6,563,475 | B2 | * | 5/2003 | Ianello et al. | 343/890 |
| 6,612,088 | B1 | * | 9/2003 | Damiano | 52/736.4 |

* cited by examiner

*Primary Examiner*—Don Wong
*Assistant Examiner*—Minh Dieu A

(57) ABSTRACT

A support system used for affixing antennas to a pole or column includes a plurality of clamps, pipes and triangular supports for positioning about a section of a column or pole. The preferred embodiment uses three pairs of clamps, three pipes and three triangular supports contoured to mount securely to a variety of pole diameters. Each pair of clamps is connected by a fastener. The pipes have a plurality of slots or openings to allow for adjustments to different column or pole diameters. The pipes are joined and interconnected to the triangular supports by two fasteners. The triangular supports guide the pipes and secure them to each other.

5 Claims, 3 Drawing Sheets

FIG. 1
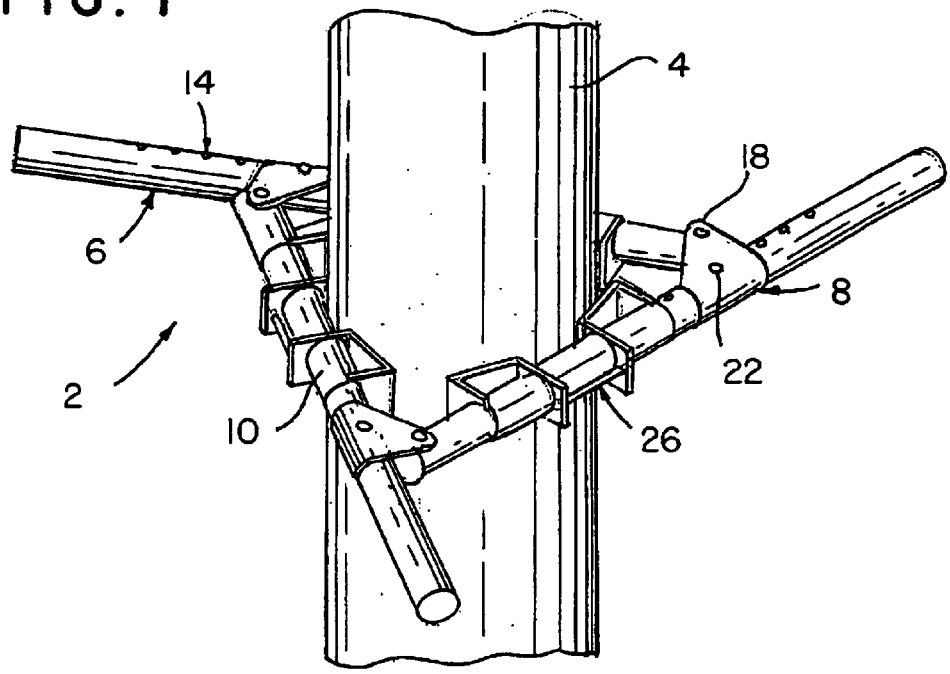
FIG. 2
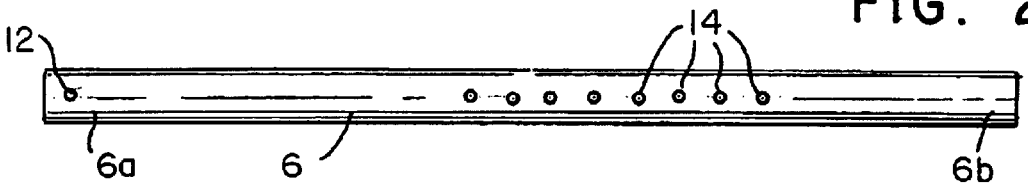
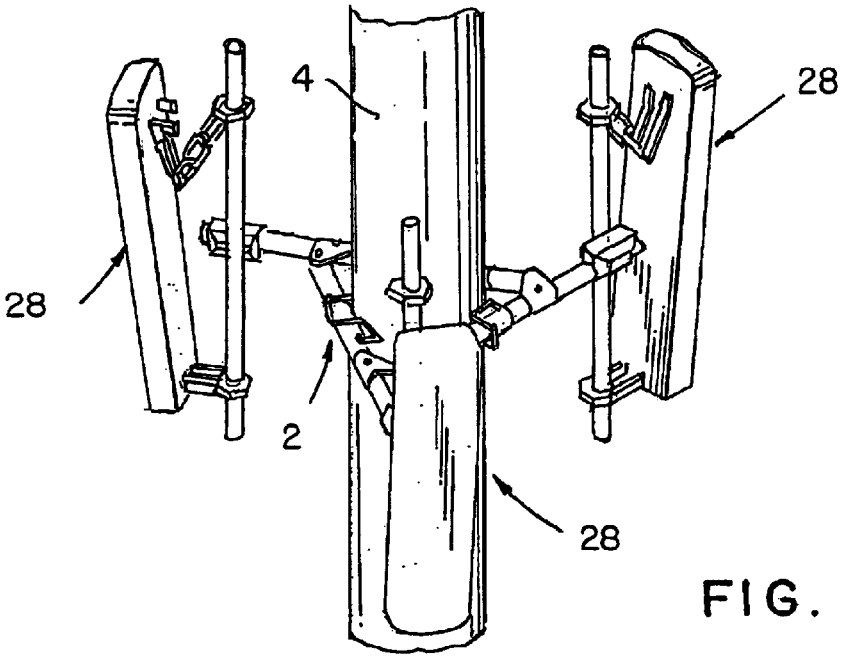
FIG. 10

FIG. 3
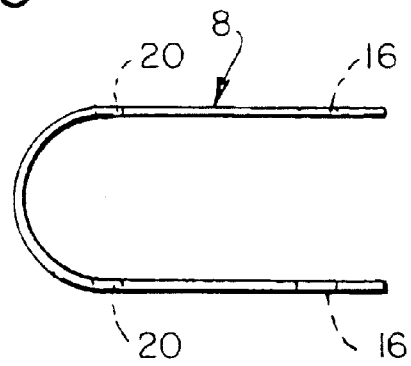
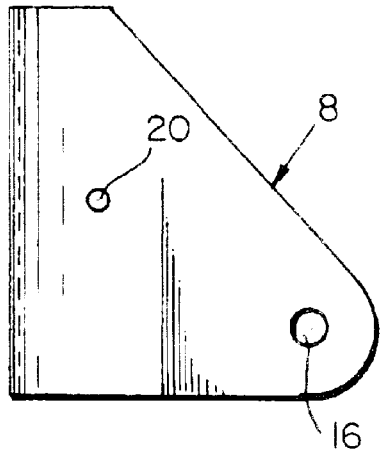
FIG. 4
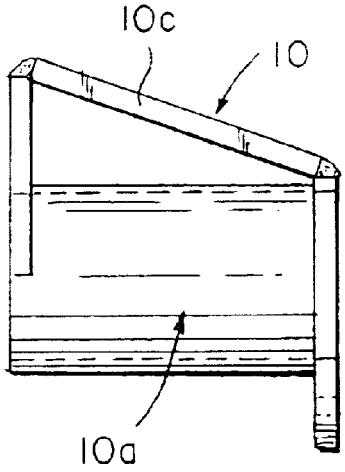
FIG. 5
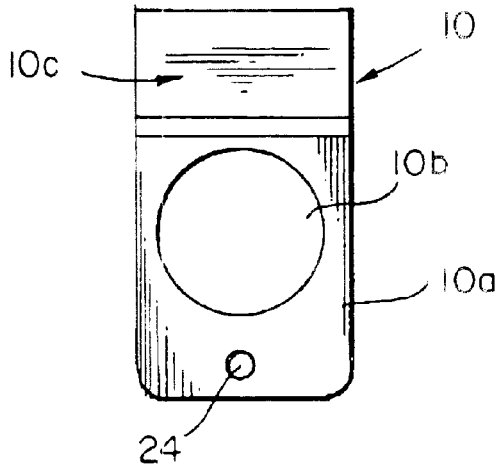
FIG. 6

FIG. 7
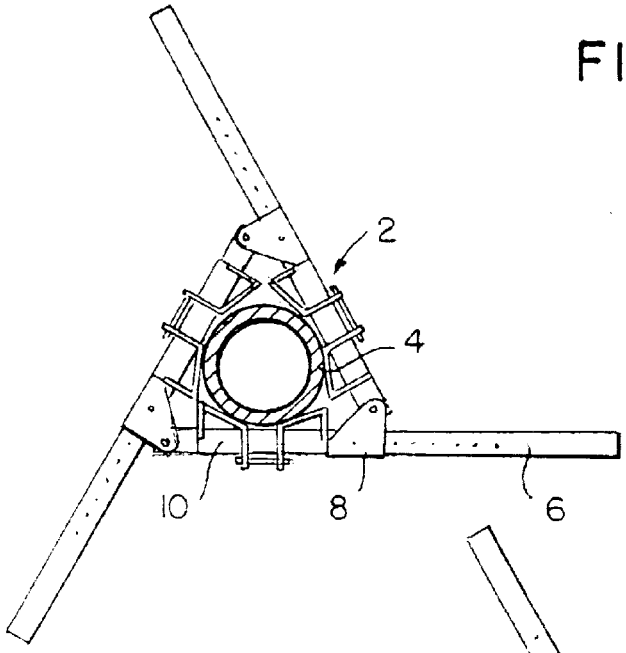
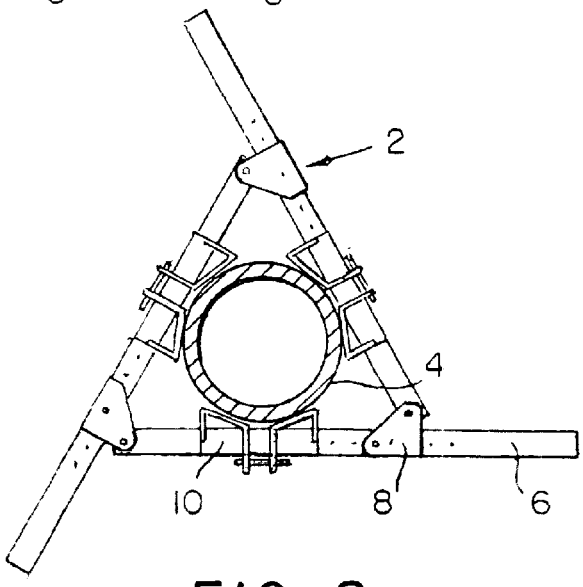
FIG. 8
FIG. 9
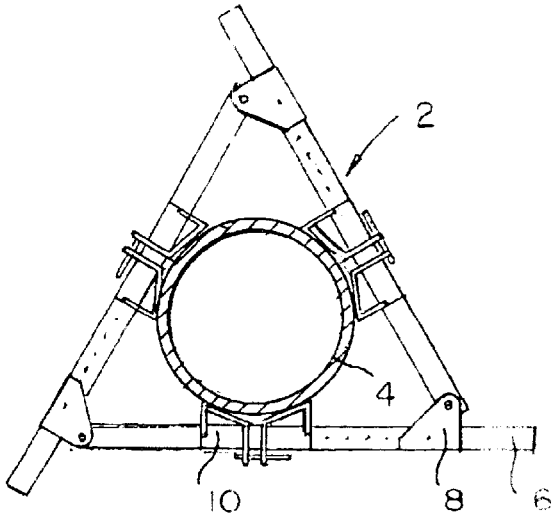

UNIVERSAL ANTENNA MOUNT

BACKGROUND OF THE INVENTION

Antenna poles or towers have long been in use for the transmission, reception and forwarding of radio and television signals. In addition, microwave antennas are in frequent demand and usage for cellular communications. Such poles generally range in height from 80 to 220 feet and more. Based on the variety of heights and load carrying capacities of these poles, pole diameters may vary greatly. Typically, these types of antenna poles range from approximately 1 to 5 feet in diameter. Furthermore, the poles may have a uniform diameter or be tapered from a thicker diameter at the bottom to a thinner one at the top.

The present invention relates to a support system for connecting antennas or antenna mounting arms to poles or other utility equipment, and more particularly, to a support system that is adaptable to provide a tight fit on poles with a wide range of design and diameters.

BRIEF DESCRIPTION OF THE PRIOR ART

Several systems have been developed in order to mount antenna equipment on poles or towers. The majority of solutions use clamps as a tightening device. One such clamp is illustrated in the Lundgren U.S. Pat. No. 6,018,325. However, these clamps must be individually sized for each pole diameter, greatly increasing manufacturing and stocking costs. This problem suggests the need for a system capable of adapting to a variety of pole diameters.

Another antenna support bracket is disclosed in the Stieffler U.S. Pat. No. 6,043,795. This bracket has some capability of adapting to a variety of pole diameters. However, the particular clamp and support lug of Stieffler cannot be used over the complete range of pole diameters. If the bent clamp is dimensioned to adapt to a very large pole, it will not be able to adapt properly to a small diameter pole and will have excess protrusions.

The present invention has several beneficial features. It overcomes the shortcomings of the prior art by providing a support system capable of being usable over a wide range of pole diameters. At the same time, it provides a secure mount without excessive protrusions when assembled on poles of smaller diameters.

Another beneficial feature is obtained when mounting wireless communication antennas. Typically, antenna equipment propagates over a 120° horizontal coverage area, therefore, at least three antennas are required to cover 360°. The preferred embodiment of the invention uses three pipes incorporating the 120° coverage area between each part making it ideal for this kind of equipment.

Another advantage of the inventive mounting assembly is the ease of manufacture due to simplicity and few parts. It has reduced weight, when compared to prior clamping systems, which leads to ease of assembly. Moreover, the time of installation and number of installers is dramatically reduced.

SUMMARY OF THE INVENTION

The present invention provides a support system that overcomes the disadvantages of the prior art. More specifically, the present invention provides a support system that is usable over a wide range of diameter poles and provide a secure mount.

The support system includes a plurality of clamps, pipes and triangular supports for positioning about the section of the pole. The preferred embodiment uses three pairs of clamps, three pipes and three triangular supports contoured to mount securely to a variety of pole diameters. Thus, the support system has a triangular shape that is suitable for embracing the section of any round or multi-sided pole.

The pipes are connected to each other by means of a triangular support in a fastened joint. The triangular supports guide the pipes allowing relative movement between each other.

The pipes have a plurality of through-openings to allow adjustment to different diameters. Relative position of the pipes is locked by way of a fastener that goes through a hole in the triangular support and into the openings in the pipes. This first adjustment provides the ability to adjust the space between the pipes and the pole.

A final adjustment is made by the clamps. Each pair of clamps works by way of a fastener. The clamps close the gap between the pipes and the pole, and provide a clamping force. Equipment can be installed on the pipes, which also operate as a mounting assembly.

BRIEF DESCRIPTION OF THE DRAWINGS

Other objects and advantages of the invention will become apparent from a study of the following specification when viewed in light of the accompanying drawing, in which:

FIG. 1 is a perspective view of the antenna mounting system according to the invention;

FIG. 2 is a top plan view of a pipe of the system shown in FIG. 1;

FIGS. 3 and 4 are front sectional and top plan views, respectively, of a support member of the system shown in FIG. 1;

FIGS. 5 and 6 are front and side views, respectively, of a clamping member of the system shown in FIG. 1;

FIGS. 7, 8, and 9 are top sectional views showing the antenna mounting system of the invention mounted on poles of increasing diameter, respectively; and FIG. 10 is a perspective view of the antenna mounting system according to the invention including antennas connected with the free end of the pipes thereof.

DETAILED DESCRIPTION

Referring first to FIG. 1, there is shown the antenna mounting system 2 of the invention mounted on a cylindrical pole 4. The mounting pole 4 is conventional and extends from 80 to 200 feet into the air. The pole is shown having a cylindrical configuration since that is the shape most used in the telecommunications industry. However, the invention can be adapted for mounting on polygonal poles as well.

The mounting system comprises three basic components, namely, pipes 6, supports 8, and clamping members 10. Preferably, three pipes, three supports and six clamping members are used for each system, but other numbers of components may be used as well.

A pipe 6 according to the invention is shown in more detail in FIG. 2. The pipe is cylindrical and formed of a rigid material such as metal. At a first end 6*a*, the pipe includes a first through-opening 12, and preferably a pair of aligned through-openings in top and bottom portions of the pipe. The pipe further contains a plurality of spaced second through-openings 14 in the intermediate portion thereof. Like the openings 12, the second openings 14 are also preferably arranged with aligned pairs of openings in the opposite surface of the pipe. The pipe also includes a remote or free end portion 6*b*. Each of the pipes of the assembly are identical to the pipe shown in FIG. 2.

Connected with the first end 6*a* of each pipe is a support member 8 as shown in FIG. 1. The support member will be described in connection with FIGS. 3 and 4. As shown therein, each support members has a generally triangular configuration with a U-shaped cross-sectional configuration for receiving the first end 6*a* of a pipe 6. The support member contains a pair of first aligned openings 16 adapted to receive a pin or bolt 18 as shown in FIG. 1. When the support member is arranged on the first end 6*a* of a pipe, the openings 16 are aligned with the openings 12 in the pipe and the bolt passes through the aligned openings to pivotally connect the support member with the pipe first end.

Each support member also contains a pair of second aligned openings 20. An adjacent pipe is arranged within the U-shaped portion of the support member 8. The adjacent pipe is slid through the support member to a position wherein the assembly is snugly fit onto the pole. Preferably, all three of the pipes are simultaneously positioned relative to the corresponding support members to position the assembly onto the pole. A second pin or bolt 22 passes through openings 20 in the support member and through a selected one of the second openings 14 in the intermediate portion of the adjacent pipe. By selecting one of the spaced pairs of second openings 14, the assembly can be adjusted to accommodate poles of different diameter as shown in FIGS. 7–9.

Final clamping of the assembly on a pole is accomplished by way of the clamping members 10 which will be described with reference to FIGS. 5 and 6. Each clamping member includes a sleeve portion 10*a* which contains an opening 10*b* adapted to receive a pipe as shown in FIG. 1. Each clamping member further includes a clamping surface 10*c* preferably arranged at an angle and adapted to abut against the pole. A pair of clamping members are arranged on each pipe with their clamping surfaces diverging as shown in FIG. 1.

Below the sleeve, each clamping member contains a hole 24 adapted to receive a bolt 26. After the assembly has been positioned on the pole and the support members connected with adjacent pipes to snugly fit the assembly on the pole, the clamping members on each pipe are drawn together by tightening the bolts 26 to securely affix the assembly on the pipe.

Like the pipe, the support members and clamping members are also formed of a rigid material, preferably metal. Galvanized steel is preferred for the pipes, supporting members, clamping members, and bolts or pins so as to prevent corrosion.

Antennas or other telecommunication devices 28 are connected with the free ends of the pipes in a known manner as shown in FIG. 10. The mounting assembly is versatile in that is can be used on poles of different diameter or configuration as shown in FIGS. 7–9. It may also be used on tapered poles.

While the preferred forms and embodiments of the invention have been illustrated and described, it will be apparent to those or ordinary skill in the art that various changes and modifications may be made without deviating from the inventive concepts set forth above.

What is claimed is:

1. Apparatus for mounting antennas on poles of different diameters, comprising:

(a) a plurality of pipes, each pipe containing first through-openings at one end thereof and a plurality of second through-openings arranged in spaced relation in an intermediate portion thereof, all of said through-openings having parallel axes;

(b) a plurality of supports, each containing two pairs of aligned openings, one of said pair of openings receiving a first pin which passes through said first through-openings in an end of said pipe for pivotally connecting said support therewith, the other of said pair of openings receiving a second pin which passes through a selected one of said second through-openings in an adjacent pipe for adjustably locking said pipes together and an angle; and (c) clamping members adjustably connected with each of said pipes, said clamping members including clamping surfaces which abut the pole when said pipes are in a clamping position.

2. Apparatus as defined in claim 1, wherein said supports have a generally U-shaped cross-sectional configuration for receiving said pipe intermediate portion.

3. Apparatus for mounting antennas on poles of different diameters comprising:

(a) a plurality of pipes, each pipe containing first through-openings at one end thereof and a plurality of second through-openings arranged in spaced relation in an intermediate portion thereof, all of said through-openings having parallel axes;

(b) a plurality of supports, each pivotally connected with one end of one of said plurality of pipes, respectively, said supports each including a locking mechanism for adjustably locking said one end of said pipe with an intermediate portion of an adjacent pipe; and (c) clamping members adjustably connected with each of said pipes, said clamping members including a sleeve for slidably receiving one of said pipes and a clamping surface which abuts the pole when said pipes are in a clamping position, said clamping surface being arranged at an angle relative to an axis of said sleeve.

4. Apparatus as defined in claim 3, wherein a pair of clamping members are arranged on each pipe, and further wherein means are provided for connecting said pair of clamping members together, thereby to further clamp the apparatus on the pole.

5. Apparatus as defined in claim 4, wherein said clamping surfaces of said pair of clamping members are arranged in diverging relation.

* * * * *